US011286850B2

(12) United States Patent
Nou et al.

(10) Patent No.: US 11,286,850 B2
(45) Date of Patent: Mar. 29, 2022

(54) COMBUSTION CHAMBER STRUCTURE FOR ENGINE

(71) Applicant: Mazda Motor Corporation, Hiroshima (JP)

(72) Inventors: Yoshihisa Nou, Aki-gun (JP); Osamu Aoki, Aki-gun (JP); Yuji Harada, Aki-gun (JP); Kenji Uchida, Aki-gun (JP); Xiyao Ge, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/205,279

(22) Filed: Mar. 18, 2021

(65) Prior Publication Data

US 2021/0332749 A1 Oct. 28, 2021

(30) Foreign Application Priority Data

Apr. 24, 2020 (JP) ..... JP2020-077269

(51) Int. Cl.
*F02B 77/11* (2006.01)
*F02F 3/10* (2006.01)
*F02F 3/26* (2006.01)

(52) U.S. Cl.
CPC ..... *F02B 77/11* (2013.01); *F02F 3/26* (2013.01)

(58) Field of Classification Search
CPC ... F02B 77/11; F02B 77/02; F02F 3/10; F02F 3/14; F02F 1/24; F02F 7/0087; F02F 1/12; F16J 9/26; F16J 1/01
See application file for complete search history.

(56) References Cited

U.S. PATENT DOCUMENTS 5,738,061 A * 4/1998 Kawamura ..... F02F 7/008 123/193.1
2013/0239924 A1* 9/2013 Sato ..... F02B 77/11 123/198 R
2013/0327289 A1* 12/2013 Hiratsuka ..... F02F 3/12 123/193.6
2015/0204233 A1* 7/2015 Nanba ..... C23C 18/31 123/668

(Continued)

FOREIGN PATENT DOCUMENTS

JP 2018172997 A 11/2018

*Primary Examiner* — Long T Tran
(74) *Attorney, Agent, or Firm* — Alleman Hall Creasman & Tuttle LLP

(57) ABSTRACT

A combustion chamber structure for an engine includes a combustion chamber that is defined by a cylinder block, a cylinder head, and a piston. The cylinder head includes: a head body that has a lower surface opposing the combustion chamber; and a coat layer that covers the lower surface. The coat layer includes: a heat-insulating layer that is arranged in a region, which opposes a cavity, in the lower surface and has a lower thermal conductivity than the head body; a heat-shielding layer that is arranged to cover the lower surface and has a lower thermal conductivity than the head body and the heat-insulating layer; and a heat diffusion layer that is arranged between the heat-insulating layer and the heat-shielding layer and has a higher thermal conductivity. The heat diffusion layer includes a side end edge and an extending portion, each of which abuts the head body.

20 Claims, 11 Drawing Sheets

(56) References Cited

U.S. PATENT DOCUMENTS

| | | | | |
|---|---|---|---|---|
| 2015/0204269 | A1* | 7/2015 | Hiratsuka | F01L 3/04 123/193.3 |
| 2016/0025035 | A1* | 1/2016 | Kadoshima | F16J 1/01 252/62 |
| 2016/0138515 | A1* | 5/2016 | Baek | F02B 77/11 123/193.5 |
| 2017/0058793 | A1* | 3/2017 | Harada | F02M 45/12 |
| 2017/0284333 | A1* | 10/2017 | Kawanaka | B22F 5/008 |
| 2017/0328300 | A1* | 11/2017 | Ikai | F02F 3/0084 |

* cited by examiner

FIG. 7

| | | THERMAL CONDUCTIVITY: λ | VOLUME SPECIFIC HEAT: ρC | THERMAL DIFFUSIVITY: λ/ρc | | ASSUMED THICKNESS: t (mm) | THERMAL RESISTANCE t/λ | HEAT PERMEABILITY: √λρc |
|---|---|---|---|---|---|---|---|---|
| HEAT SHIELDING LAYER | | 0.2 | 1000 | 0.0002 | 1 | 0.075 | 0.3750 | 14 |
| HEAT DIFFUSION LAYER | Cu-BASED MATERIAL | 400 | 3500 | 0.1143 | 571 | 2 | 0.0050 | 1183 |
| | CORSON ALLOY | 239 | 3349.5 | 0.0714 | 357 | 2 | 0.0084 | 895 |
| | BERYLLIUM COPPER | 125 | 3460 | 0.0361 | 181 | 2 | 0.0160 | 658 |
| | FIBER-REINFORCED ALUMINUM ALLOY | 100 | 3120 | 0.0321 | 160 | 2 | 0.0200 | 559 |
| | TITANIUM ALUMINUM | 40 | 2340 | 0.0171 | 85 | 2 | 0.0500 | 306 |
| HEAT-INSULATING LAYER | CALCIUM SILICATE | 0.24 | 2000 | 0.00012 | 0.6 | 2 | 8.3333 | 22 |
| | $ZrO_2$ ZIRCONIA | 3 | 2576 | 0.0012 | 6 | 2 | 0.6667 | 88 |
| | POROUS SUS-BASED MATERIAL | 5 | 2352 | 0.0021 | 11 | 3.5 | 0.7000 | 108 |
| | ↑ (HIGH RELATIVE DENSITY) | 8 | 2970 | 0.0027 | 13 | 5 | 0.6250 | 154 |
| CYLINDER BLOCK AND HEAD BASE MATERIAL | AC4B | 96 | 2667 | 0.0360 | 180 | 6 | 0.0625 | 506 |
| PISTON BASE MATERIAL | AC8A | 125 | 2600 | 0.0481 | 240 | 4 | 0.0320 | 570 |
| INTAKE VALVE BASE MATERIAL | SUH11 | 25 | 3850 | 0.0065 | 32 | 4 | 0.1600 | 310 |
| EXHAUST VALVE BASE MATERIAL | SUH35 | 18 | 3565 | 0.0050 | 25 | 4 | 0.2222 | 253 |
| | | (W/mK) | (kJ/m³·K) | | | | (m²·K/W) | |

COMBUSTION CHAMBER STRUCTURE FOR ENGINE

TECHNICAL FIELD

The present invention relates to a combustion chamber structure for an engine, the combustion chamber structure including a heat-shielding layer that suppresses cooling loss.

BACKGROUND ART

A combustion chamber in a vehicular gasoline engine or the like is requested to reduce heat dissipation (cooling loss) through a wall surface of the combustion chamber. In order to reduce the cooling loss, a technique of coating the wall surface of the combustion chamber, such as a crown surface of a piston, with a heat-shielding layer that is formed from a material with low thermal conductivity is known. By providing the heat-shielding layer, a temperature difference between combustion gas, which is produced in the combustion chamber, and the wall surface of the combustion chamber can be reduced, and the cooling loss can thereby be reduced.

In Patent Document 1, a combustion chamber structure that is provided with a heat-insulating layer on the crown surface of the piston in addition to the heat-shielding layer is disclosed. The heat-shielding layer covers the entire crown surface of the piston and suppresses the heat dissipation through a piston body. The heat-insulating layer is arranged underneath the heat-shielding layer and in a radially-center region of the crown surface of the piston, and sets the center region as a region from which heat is less likely to be dissipated. As a result, such temperature distribution is provided that a radially-center region of the combustion chamber is at a relatively high temperature and a radially-outer region thereof is at a relatively low temperature. Such temperature distribution has an advantage of slowing combustion at the time when Homogeneous-Charge Compression Ignition (HCCI) combustion is conducted, so as to be able to suppress a rapid increase in in-cylinder pressure and cooling loss.

PRIOR ART DOCUMENTS

Patent Documents

Patent Document 1: JP2018-172997A

SUMMARY OF THE INVENTION

Problem to be Solved by the Invention

The combustion chamber in the engine is also defined by a lower surface of a cylinder head. Accordingly, in order to reduce the cooling loss in the combustion chamber, it is also necessary to suppress the heat dissipation from the lower surface of the cylinder head. Thus, it is considered to also provide the heat-shielding layer and the heat-insulating layer to the lower surface of the cylinder head as in Patent Document 1. However, a defect possibly occurs in which the heat-insulating layer stores excess heat, which raises a temperature of the lower surface of the cylinder head to a high temperature. That is, the heat-insulating layer stores the heat that cannot be blocked by the heat-shielding layer, and the heat-insulating layer that maintains the high temperature heats the heat-shielding layer. Due to this heating, the temperature of the lower surface of the cylinder head is raised to the high temperature, which raises an in-cylinder temperature. As a result, air that is introduced in an intake stroke is heated excessively, which causes preignition in a compression stroke.

The present invention has a purpose of providing a combustion chamber structure for an engine capable of suppressing a temperature rise in a lower surface of a cylinder head to a high temperature, which possibly causes preignition, while reducing cooling loss.

Means for Solving the Problem

A combustion chamber structure for an engine according to one aspect of the present invention is a combustion chamber structure for an engine including a combustion chamber that is defined by a cylinder block, a cylinder head, and a piston. The cylinder head includes: a head body that has a lower surface opposing the combustion chamber; a heat-insulating layer that is arranged on the lower surface and has a lower thermal conductivity than the head body; a heat-shielding layer that is arranged to cover the lower surface and has a lower thermal conductivity than the head body and the heat-insulating layer; and a heat diffusion layer that is arranged between the heat-insulating layer and the heat-shielding layer and has a higher thermal conductivity than the heat-insulating layer and the heat-shielding layer. The heat diffusion layer includes an abutment portion that abuts the head body.

According to this combustion chamber structure, the lower surface of the head body is covered with the heat-shielding layer, the thermal conductivity of which is lower than that of the head body of the cylinder head and the heat-insulating layer. Thus, a temperature difference between the head body and the combustion chamber can be reduced, and heat transfer to the head body (cooling loss) can thereby be reduced. In addition, the heat-insulating layer stores heat that has passed through the heat-shielding layer. Thus, the heat-shielding layer (the lower surface of the head body) can be maintained at a high temperature. Meanwhile, the heat diffusion layer is arranged between the heat-insulating layer and the heat-shielding layer. The heat diffusion layer includes the abutment portion that has the higher thermal conductivity than both of the heat-insulating layer and the heat-shielding layer and that abuts the head body. Thus, even when the heat-insulating layer is brought into a state of excessively storing the heat, such heat can be dissipated to the head body through the heat diffusion layer. Therefore, it is possible to prevent a temperature rise of the lower surface of the head body to the high temperature, which possibly causes preignition.

In the combustion chamber structure for the engine, the heat-insulating layer is desirably arranged in a part of a radially-center region of the lower surface.

In general, the radially-center region of the combustion chamber has a tendency to increase in temperature to the high temperature during combustion. Accordingly, a temperature of a radially-center region in the lower surface of the head body also increases to the high temperature. According to the combustion chamber structure, the heat-insulating layer is arranged on a back surface side of the heat-shielding layer in the part of the radially-center region, that is, at least the part of the region which increases in temperature to the high temperature during the combustion. Thus, a temperature difference between combustion gas in the combustion chamber and the heat-shielding layer can be reduced as small as possible, and the cooling loss can thereby be reduced. Meanwhile, since the heat of the heat-insulating layer is dissipated to the head body due to interposition of the heat diffusion layer, the heat of the heat-shielding layer is not raised excessively.

In the combustion chamber structure for the engine, the heat diffusion layer desirably includes an extending portion that extends toward a radially outer side of an outer peripheral edge of the heat-insulating layer and/or toward a radially inner side of an inner peripheral edge of the heat-insulating layer, and the extending portion is desirably the abutment portion that abuts the head body.

According to this combustion chamber structure, compared to a case where the heat diffusion layer and the heat-insulating layer are the same size and the side edge portion of the heat diffusion layer is the abutment portion with the head body, it is possible to increase a contact area between the heat-insulating layer and the head body by the extending portion. Therefore, the heat of the heat-insulating layer can further easily be released to the head body.

In the combustion chamber structure for the engine, in a radially-center region of an upper surface, the piston desirably includes a cavity that is dented downward in a cylinder-axis direction, and, in the lower surface of the head body, the heat-insulating layer and the heat diffusion layer are desirably arranged in a region that opposes the cavity.

In general, in the case where the cavity is provided in the radially-center region of a piston upper surface, the temperature of the radially-center region in the combustion chamber tends to be raised to the high temperature during the combustion. Naturally, a temperature of a region, which opposes the cavity, in the lower surface of the head body is also raised to the high temperature. According to the combustion chamber structure, the heat-insulating layer is arranged in the region, which opposes the cavity, in the lower surface of the head body. That is, in the region which increases in temperature to the high temperature during the combustion, in the lower surface, the heat-insulating layer is arranged on the back surface side of the heat-shielding layer. Thus, a temperature difference between the combustion gas in the combustion chamber and the heat-shielding layer (the lower surface of the head body) can be reduced as small as possible, and the cooling loss can thereby be reduced. Meanwhile, since the heat of the heat-insulating layer is dissipated to the head body due to the interposition of the heat diffusion layer, the heat of the heat-shielding layer is not raised excessively.

In the combustion chamber structure for the engine, the cavity desirably includes: a bottom surface that is formed with the most dented portion in the cylinder-axis direction; a raised surface that is raised radially outward and upward from the bottom surface; and a peripheral edge portion that is an upper end edge of the raised surface. In the lower surface of the head body, the heat-insulating layer and the heat diffusion layer are desirably arranged in a region that opposes the raised surface and the peripheral edge portion.

In the case where the cavity with the above structure is provided to the upper surface of the piston, a flame is guided upward along the raised surface from the bottom surface of the cavity during the combustion, and blows and hits the lower surface of the head body. That is, the region, which opposes the raised surface and the peripheral edge portion, in the lower surface of the head body serves as a region where the flame blows and hits, and thus a temperature of such a region is especially raised to the high temperature. Thus, when the heat-insulating layer is arranged in the region where the flame blows and hits, the cooling loss can be reduced. Meanwhile, since the heat of the heat-insulating layer is dissipated to the head body due to the interposition of the heat diffusion layer, it is possible to suppress the excessive heat rise.

In the combustion chamber structure for the engine, outer peripheral edges of the heat-insulating layer and the heat diffusion layer desirably extend to an outer peripheral edge of the combustion chamber or a portion near the outer peripheral edge of the combustion chamber.

According to the combustion chamber structure, since the heat-insulating layer is arranged in the substantially entire region of the lower surface of the head body, the cooling loss through the cylinder head can be suppressed at a maximum. In addition, the heat of the heat-insulating layer can be dissipated to the head body through the abutment portion of the heat diffusion layer.

In the combustion chamber structure for the engine, the heat-insulating layer is composed of a ceramic material, the heat-shielding layer is composed of a heat-resistant silicone resin, and the heat diffusion layer is composed of a copper-based material, a Corson alloy, beryllium copper, a fiber-reinforced aluminum alloy, or a titanium aluminum.

Advantage of the Invention

According to the present invention, it is possible to provide the combustion chamber structure for the engine capable of suppressing the temperature rise of the lower surface of the cylinder head to the high temperature, which possibly causes preignition, while reducing the cooling loss.

BRIEF DESCRIPTION OF THE DRAWINGS

FIG. 7 is a table listing materials that can be applied as a constituent of the combustion chamber structure for the engine.

MODES FOR CARRYING OUT THE INVENTION

[Overall Configuration of Engine]

Figure 1:
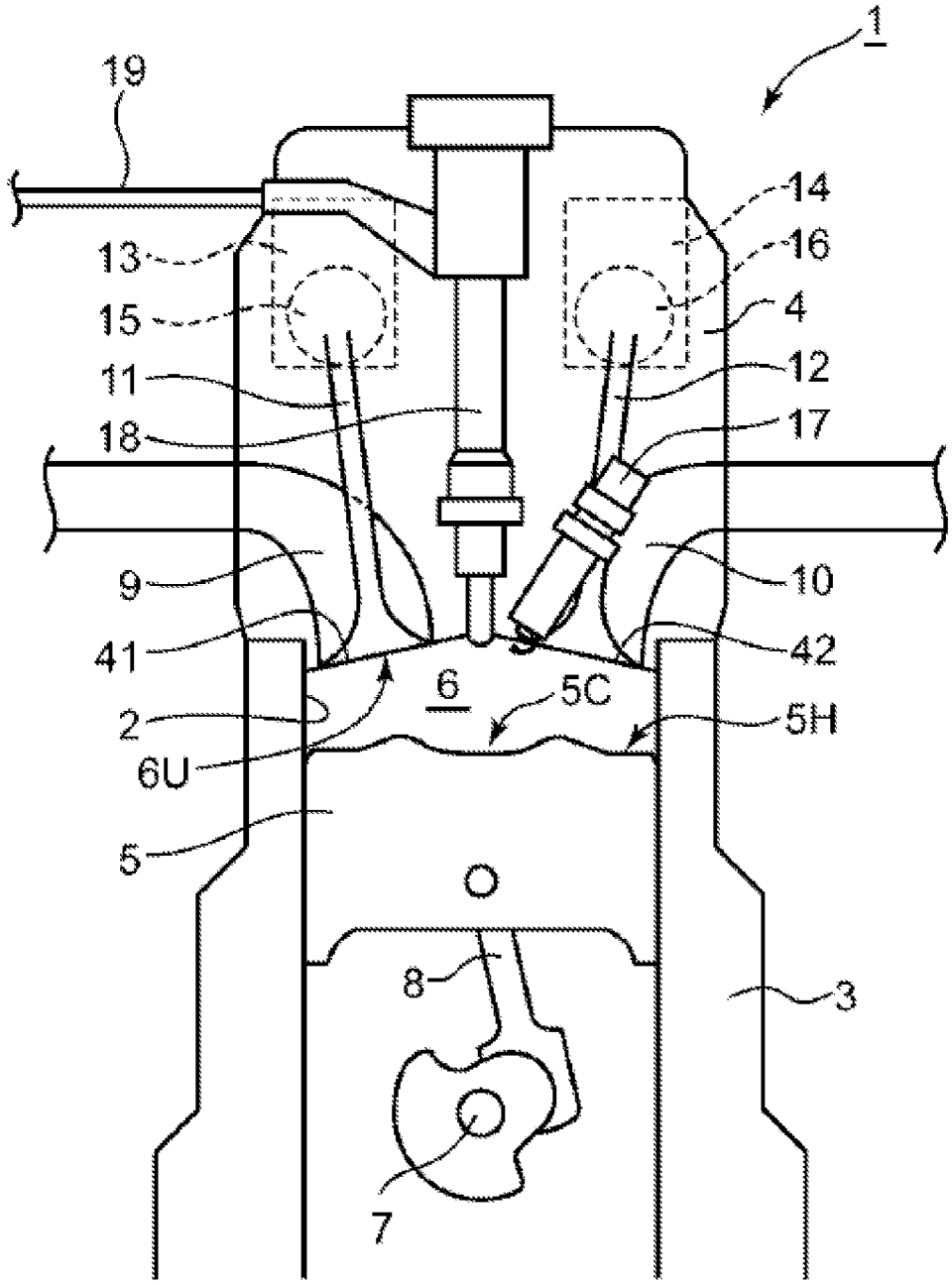
FIG. 1 is a schematic cross-sectional view illustrating an engine to which a combustion chamber structure for an engine according to an embodiment of the present invention is applied.

A detailed description will hereinafter be made on a combustion chamber structure for an engine according to an embodiment of the present invention with reference to the drawings. FIG. 1 is a schematic cross-sectional view illustrating an engine to which the combustion chamber structure for the engine according to the embodiment of the present invention is applied. The engine illustrated herein is a multicylinder engine that includes a cylinder and a piston and is mounted, as a power source for driving a vehicle such as an automobile, on the vehicle. The engine includes an engine body 1 and auxiliary machines such as intake/exhaust manifolds and various pumps that are not illustrated and are assembled thereto.

The engine body 1 in this embodiment is an engine that can conduct spark ignition combustion (SI combustion) in which an air-fuel mixture of fuel and air is ignited by a spark in a combustion chamber, and Homogeneous-Charge Compression Ignition (HCCI) combustion in which the air-fuel mixture is self-ignited. The fuel that is supplied to the engine body 1 has gasoline as a main component. In general, in the engine body 1, the SI combustion is conducted in a high-load or high-speed operation range, and the HCCI combustion is conducted in a low-to-middle load and low-to-middle speed operation range. The present invention can also be applied to a combustion chamber for an engine in which the HCCI combustion cannot be conducted.

The engine body 1 includes a cylinder block 3, a cylinder head 4, and a piston 5. The cylinder block 3 has a plurality of cylinders 2 (only one thereof is illustrated in FIG. 1) that are aligned in a perpendicular direction to the sheet of FIG. 1. The cylinder head 4 is attached to an upper surface of the cylinder block 3 and closes an upper opening of the cylinder 2. The piston 5 is accommodated in each of the cylinders 2 in a slidably reciprocating manner and is coupled to a crankshaft 7 via a connecting rod 8. The crankshaft 7 rotates about a center axis thereof according to reciprocating motion of the piston 5. A crown surface 5H of the piston 5 is formed with a cavity 5C that is dented downward in a cylinder-axis direction.

A combustion chamber 6 is formed above the piston 5. The cylinder head 4 is formed with an intake port 9 and an exhaust port 10, each of which communicates with the combustion chamber 6. A lower surface (a combustion chamber ceiling surface 6U) of the cylinder head 4 is formed with, as openings to the combustion chamber 6, an intake-side opening 41 that is a downstream end of the intake port 9 and an exhaust-side opening 42 that is an upstream end of the exhaust port 10.

An intake valve 11 for opening and closing the intake-side opening 41 and an exhaust valve 12 for opening and closing the exhaust-side opening 42 are assembled to the cylinder head 4. The engine body 1 of this embodiment is a double overhead camshaft (DOHC) engine, two each of the intake-side openings 41 and the exhaust-side openings 42 are provided to each of the cylinders 2, and two each of the intake valves 11 and the exhaust valves 12 are also provided thereto.

The combustion chamber 6 is defined by the cylinder block 3, cylinder head 4, and the piston 5. In detail, combustion chamber wall surfaces that define the combustion chamber 6 are an inner wall surface of the cylinder 2, the crown surface 5H as an upper surface of the piston 5, the combustion chamber ceiling surface 6U as the lower surface of the cylinder head 4, and an umbrella portion of each of the intake valve 11 and the exhaust valve 12. The combustion chamber ceiling surface 6U in this embodiment has a pent roof shape.

In the cylinder head 4, an intake-side valve mechanism 13 and an exhaust-side valve mechanism 14 that respectively drive the intake valve 11 and the exhaust valve 12 are disposed. These valve mechanisms 13, 14 respectively drive shaft portions of the intake valve 11 and the exhaust valve 12 in an interlocking manner with rotation of the crankshaft 7. By this driving, a valve head of the intake valve 11 opens and closes the intake-side opening 41, and a valve head of the exhaust valve 12 opens and closes the exhaust-side opening 42.

An intake-side variable valve timing mechanism (an intake-side S-VT) 15 is assembled to the intake-side valve mechanism 13. The intake-side S-VT 15 is an electric S-VT that is provided to an intake camshaft, and changes opening and closing timings of the intake valve 11 by continuously changing a rotation phase of the intake camshaft with respect to the crankshaft 7 within a specified angle range. Similarly, an exhaust-side variable valve timing mechanism (an exhaust-side S-VT) 16 is assembled to the exhaust-side valve mechanism 14. The exhaust-side S-VT 16 is an electric S-VT that is provided to an exhaust camshaft, and changes opening and closing timings of the exhaust valve 12 by continuously changing a rotation phase of the exhaust camshaft with respect to the crankshaft 7 within a specified angle range.

An ignition plug 17 that supplies ignition energy to the air-fuel mixture in the combustion chamber 6 is provided per cylinder 2 and attached to the cylinder head 4. The ignition plug 17 is attached to the cylinder head 4 in such a posture that, at a position near a radial center of the combustion chamber ceiling surface 6U, an ignition portion thereof faces inside of the combustion chamber 6. The ignition plug 17 produces a spark from a tip thereof in response to supply of electricity from an ignition circuit, which is not illustrated, so as to ignite the air-fuel mixture in the combustion chamber 6. In this embodiment, the ignition plug 17 is used when the SI combustion is conducted under high load and at the high speed. The ignition plug 17 is also used in the case where the HCCI combustion is conducted and the self-ignition is difficult like a time immediately after a cold start of the engine, in the case where the HCCI combustion is assisted under specified load or under a specified speed condition (spark assist), or the like.

An injector 18 that injects the fuel having gasoline as the main component into the combustion chamber 6 from a tip is provided per cylinder 2 and attached to the cylinder head 4. The injector 18 is arranged in a radially center space of the combustion chamber ceiling surface 6U. A fuel supply pipe 19 is connected to the injector 18. The injector 18 injects the fuel, which is supplied through the fuel supply pipe 19, into the cavity 5C. A high-pressure fuel pump (not illustrated) that is constructed of a plunger pump or the like is connected to an upstream side of the fuel supply pipe 19, and the plunger pump is coupled to the crankshaft 7 in an interlocking manner.

[Detailed Structure of Piston]

Figure 2A:
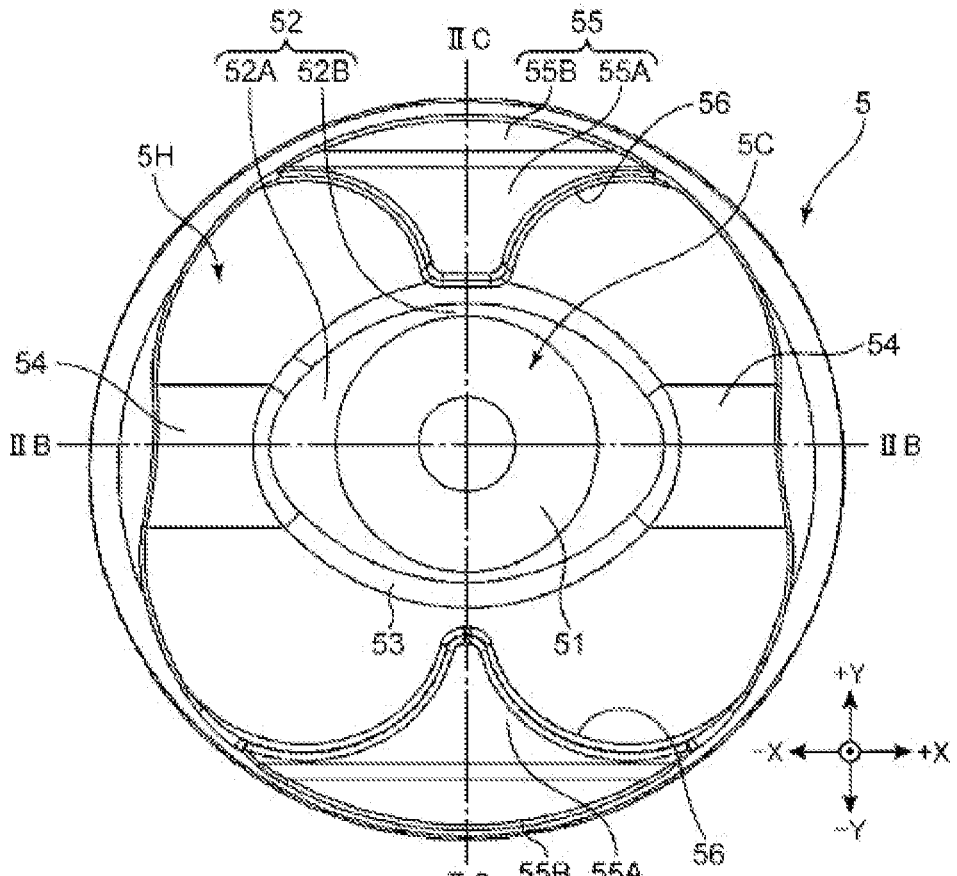
FIG. 2A is a plan view of a crown surface of a piston.
Figure 2B:
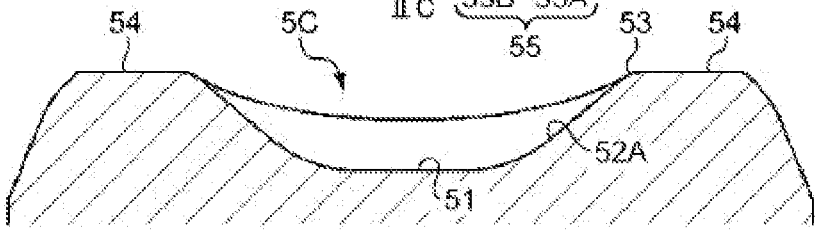
FIGS. 2B and 2C are cross-sectional views that are taken along line IIB-IIB in FIG. 2A and a cross-sectional view that is taken along IIC-IIC therein, respectively.
Figure 2C:
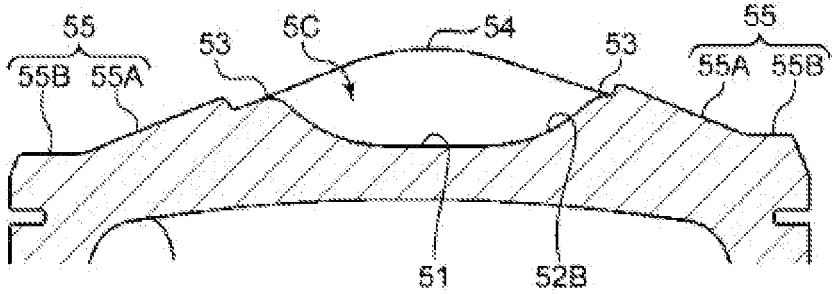

Next, a detailed description will be made on a structure of the piston 5. FIG. 2A is a plan view of the crown surface of the piston, and FIGS. 2B, 2C are a cross-sectional view that is taken along line IIB-IIB in FIG. 2A and a cross-sectional view that is taken along IIC-IIC therein, respectively. In FIGS. 2A to 2C and some of the drawings, which will be described below, X, Y, Z-directions are indicated. The X-direction is an extending direction of the crankshaft 7, the Y-direction is a direction in which the intake port 9 and the exhaust port 10 oppose each other (a cross-sectional direction in FIG. 1), and the Z-direction is the cylinder-axis direction (a vertical direction).

The piston 5 is constructed of a column body, a diameter of which is substantially equal to a bore diameter of the cylinder 2. The piston 5 has the crown surface 5H (the upper surface) that defines a bottom surface of the combustion chamber 6. This crown surface 5H is formed with the cavity 5C. The cavity 5C is arranged at a position that substantially corresponds to a radially-center region of the crown surface 5H, and has a shape in which the crown surface 5H is dented downward in the cylinder-axis direction. The injector 18, which is arranged at the radial center of the combustion chamber ceiling surface 6U, injects the fuel into the cavity 5C.

In top view, the cavity 5C has an oval shape that is long in the X-direction, and has a bottom surface 51, a raised surface 52, and a peripheral edge portion 53. The bottom surface 51 is a substantially flat circular region that forms the most dented portion in the cylinder-axis direction in the cavity 5C, and is located at a radial center of the crown surface 5H. The raised surface 52 is a surface that is raised radially outward and upward from an outer peripheral edge of the bottom surface 51. The raised surface 52 includes: a long-diameter side raised surface 52A that is an inclined surface in the X-direction and has a relatively long and gradual slope; and a short-diameter side raised surface 52B that is an inclined surface in the Y-direction and has a relatively short and steep slope. The peripheral edge portion 53 is an upper end edge of the raised surface 52 and is a ridgeline portion that serves as an outermost peripheral portion of the cavity 5C. Since the raised surface 52 is an inclined surface that has the long-diameter side raised surface 52A and the short-diameter side raised surface 52B. Thus, although the bottom surface 51 is circular in top view, the peripheral edge portion 53 has an oval shape.

The crown surface 5H further includes a mountain portion 54, a squish portion 55, and a valve recess 56. The mountain portion 54 is arranged next to a −X side and a +X side of the cavity 5C and has a mountain shape that corresponds to the pent roof-shaped combustion chamber ceiling surface 6U. The squish portion 55 is arranged at a position next to a −Y side and a +Y side of the cavity 5C. The squish portion 55 includes: an inclined portion 55A that descends radially outward from the peripheral edge portion 53; and a flat surface portion 55B that is a horizontal surface further extending radially outward from a lower end of the inclined portion 55A. The valve recess 56 is a recess provided to avoid interference with the intake valve 11 and the exhaust valve 12.

[Combustion Chamber Structure in Comparative Example]

Figure 3A:
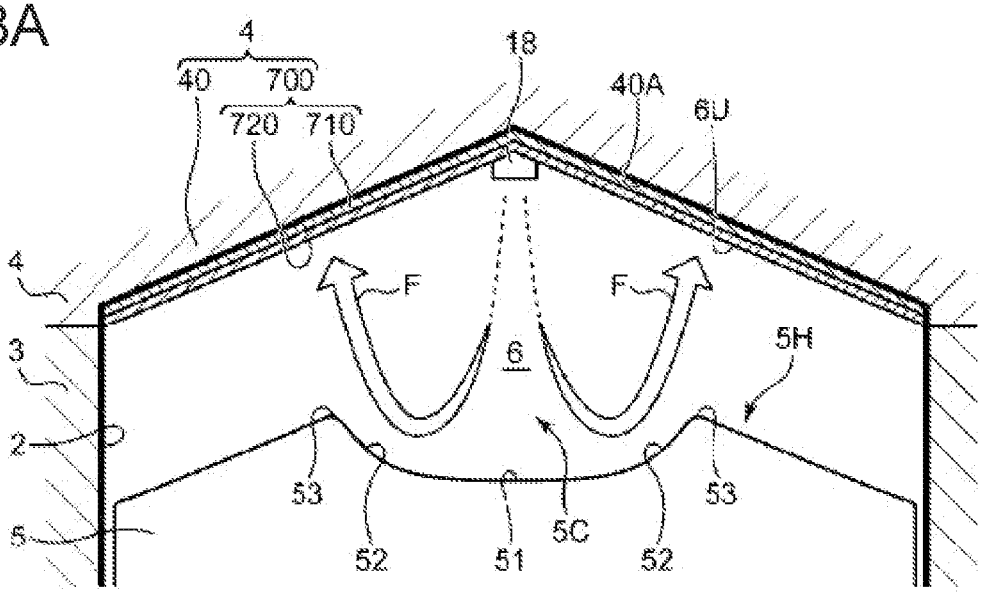
FIG. 3A is a schematic view illustrating a coat layer provided to a lower surface of a cylinder head in a comparative example.

Prior to the description on the combustion chamber structure according to the embodiment of the present invention, a description will be made on a combustion chamber structure according to a comparative example. FIG. 3A is a cross-sectional view that schematically illustrates the combustion chamber structure according to the comparative example. The cylinder head 4 includes: a head body 40 that has a lower surface 40A opposing the combustion chamber 6; and a coat layer 700 arranged on the lower surface 40A. The coat layer 700 is constructed of: a heat-insulating layer 710 that is formed to cover an entire region of the lower surface 40A; and a heat-shielding layer 720 that is formed on top of the heat-insulating layer 710. The heat-shielding layer 720 includes a coating layer that is formed from a material such as a heat-resistant silicone resin and has a sufficiently low thermal conductivity with respect to the head body 40. The heat-insulating layer 710 is formed from a member with a high volume specific heat and has a heat storage property.

Since the lower surface 40A of the head body 40 opposes the combustion chamber 6, the lower surface 40A is exposed to a high temperature. Especially, in this embodiment, the injector 18 is arranged at the radial center of the combustion chamber ceiling surface 6U, and the lower surface 40A faces the crown surface 5H, which has the cavity 5C, in the piston 5. Accordingly, a combustion flame of the air-fuel mixture that is guided to the cavity 5C blows and hits the lower surface 40A, which promotes heat transfer (cooling loss) from the lower surface 40A to the head body 40.

In FIG. 3A, a situation where the fuel injected by the injector 18 becomes a flame F and blows and hits the lower surface 40A is indicated by arrows. The fuel is injected into the cavity 5C. The cavity 5C includes the raised surface 52, which is raised in a manner to approach the lower surface 40A, around the bottom surface 51, which forms the most dented portion in the cylinder-axis direction. Accordingly, the flame F is guided upward by the raised surface 52 and eventually blows and hits the lower surface 40A. A region where the flame F is most likely to blow and hit in the lower surface 40A is a region that opposes the raised surface 52 and the peripheral edge portion 53 of the cavity 5C. In such a region where the flame F blows and hits, due to an increase in the heat transfer to the head body 40, a measure of suppressing the cooling loss has to be taken. As such a measure, the coat layer 700 is provided.

The heat-shielding layer 720 that covers the lower surface 40A is a layer with a low thermal conductivity, and a temperature thereof varies depending on an inside temperature of the combustion chamber 6. Accordingly, when a temperature difference between a temperature of combustion gas in the combustion chamber 6 and a surface temperature of the lower surface 40A is reduced, the heat transfer to the head body 40 can be blocked to a certain extent. Thus, the cooling loss can be reduced to a certain extent. Meanwhile, in general, the heat-shielding layer 720 is a thin layer that is formed from a material with a low volume specific heat. Thus, the heat-shielding layer 720 has a poor heat storage function, cannot block the heat transfer to the head body 40 completely, and thus cannot reduce the cooling loss sufficiently.

For such reasons, the heat-insulating layer 710 is arranged on a back surface side of the heat-shielding layer 720. That is, in the comparative example, the lower surface 40A of the head body 40 is covered with two layers of the heat-insulating layer 710 and the heat-shielding layer 720 on top thereof. The heat-insulating layer 710 stores the heat that has passed through the heat-shielding layer 720. Accordingly, the heat-insulating layer 710 heats (maintains the temperature of) the heat-shielding layer 720 that covers the lower surface 40A. As a result, the surface temperature of the lower surface 40A is increased to a high temperature, and thus the temperature difference from the combustion gas in the combustion chamber 6 can be reduced. In other words, the heat-insulating layer 710 blocks the heat transfer to the head body 40 from the combustion chamber 6 side and thereby suppresses heat dissipation. As a result, the cooling loss can significantly be reduced.

However, from the research conducted by the present inventors, it was found that the following problem possibly occurred to the coat layer 700 with a two-layer structure. In the case where the temperature on the inside of the combustion chamber 6 is not increased to the relatively high temperature, for example, in the case where the HCCI combustion is conducted by using a lean air-fuel mixture in the low-load operation range, the coat layer 700 in the comparative example functions efficiently. That is, the heat-insulating layer 710 has an adequate heat storage temperature and heats the heat-shielding layer 720 adequately. As a result, the surface temperature of the lower surface 40A can reach such a temperature that is suited for suppression of the cooling loss.

On the other hand, in the case where the temperature on the inside of the combustion chamber 6 is increased to the relatively high temperature, the heat-insulating layer 710 that stores the high temperature excessively heats the heat-shielding layer 720. For example, in the middle-load operation range, the engine body 1 conducts the HCCI combustion by using the lean air-fuel mixture, and in the high-load operation range, the engine body 1 conducts the SI combustion with $\lambda=1$. A fuel injection amount is relatively large in middle-load to high-load operation. Thus, the temperature of the combustion gas in the combustion chamber 6 is relatively increased. As a result, the lower surface 40A receives the high temperature, and the heat-insulating layer 710 stores the heat at the high temperature. Since such a heat-insulating layer 710 heats the heat-shielding layer 720, the surface temperature of the lower surface 40A is significantly increased. In particular, in the lower surface 40A, the surface temperature of the region where the flame F blows and hits and that opposes the raised surface 52 and the peripheral edge section 53 of the cavity 5C is especially increased.

Figure 3B:
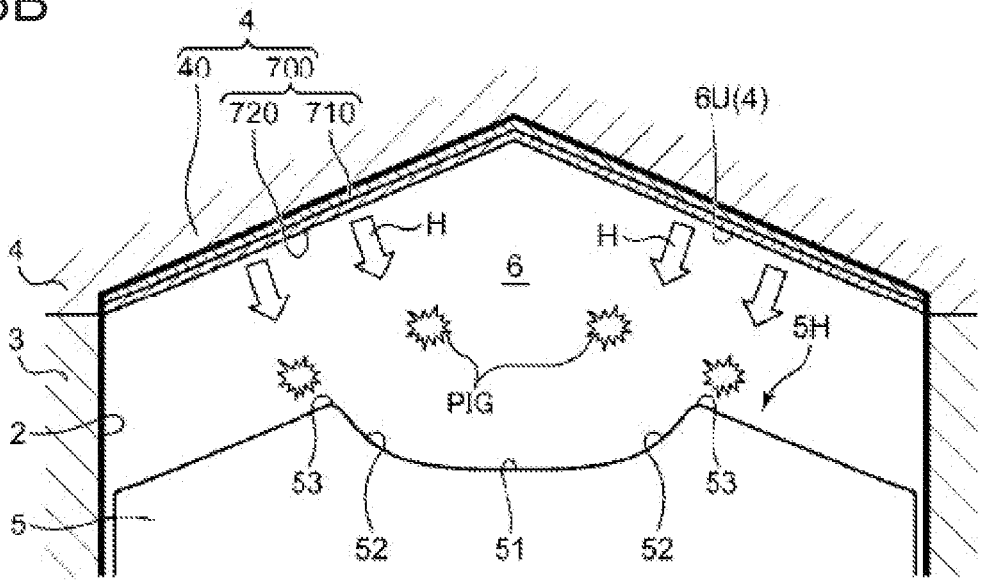
FIG. 3B is a view for illustrating preignition possibly occurring in the comparative example.

FIG. 3B is a view illustrating a phenomenon that possibly occurs in the middle-load to high-load operation in the combustion chamber structure in which the coat layer 700 in the comparative example is applied to the lower surface 40A. When the heat-insulating layer 710 stores the high heat, and the heat-shielding layer 720 is heated by such heat, the temperature of the lower surface 40A is increased to the high temperature. The lower surface 40A, which is heated to the excessively high temperature, produces heat for heating the combustion chamber 6 as indicated by arrows H and excessively increases an in-cylinder temperature. Consequently, the temperature of the air that is introduced into the combustion chamber 6 in the intake stroke is increased. Then, when the heated air is compressed in a compression stroke, preignition PIG occurs. That is, such a phenomenon occurs that the air-fuel mixture is partially ignited at an earlier timing than original compression ignition timing. In this case, defects such as fluctuations, reduced output, and the like of torque of the engine body 1 possibly occur.

[Exemplification of Combustion Chamber Structure According to this Embodiment]

In this embodiment, the combustion chamber structure capable of suppressing occurrence of the preignition PIG, which is illustrated in FIG. 3B, while reducing the cooling loss to the head body 40 through the lower surface 40A of the cylinder head 4 is provided. In First to Third Examples, which will be described below, various coat layers that are applied to the lower surface 40A in order to obtain the combustion chamber structure will be exemplified.

First Example

Figure 4:
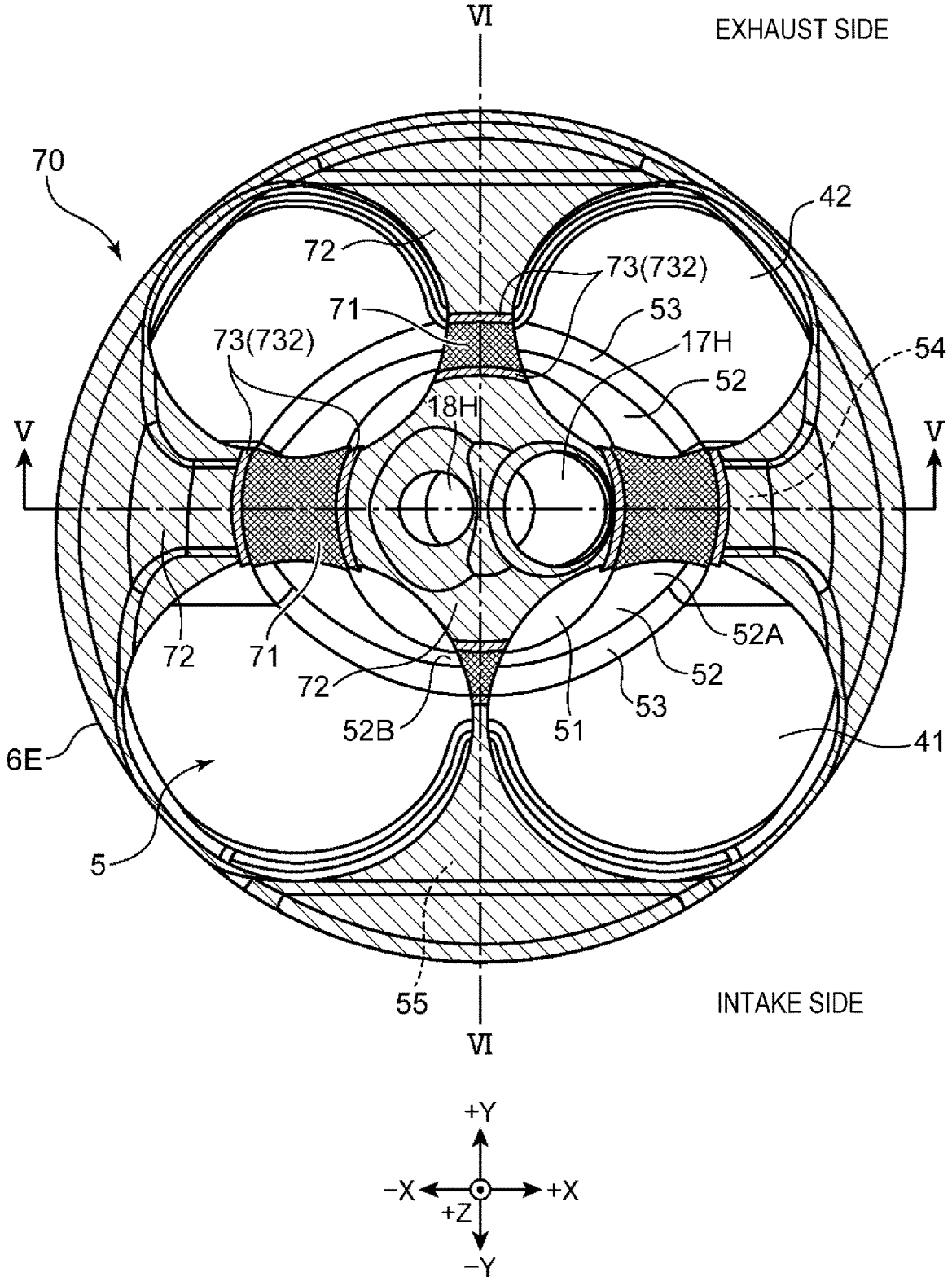
FIG. 4 is a plan view of the combustion chamber structure according to this embodiment that is seen in top view and, in particular, a view illustrating a coat layer provided on a lower surface of a cylinder head in a First Example.
Figure 5:
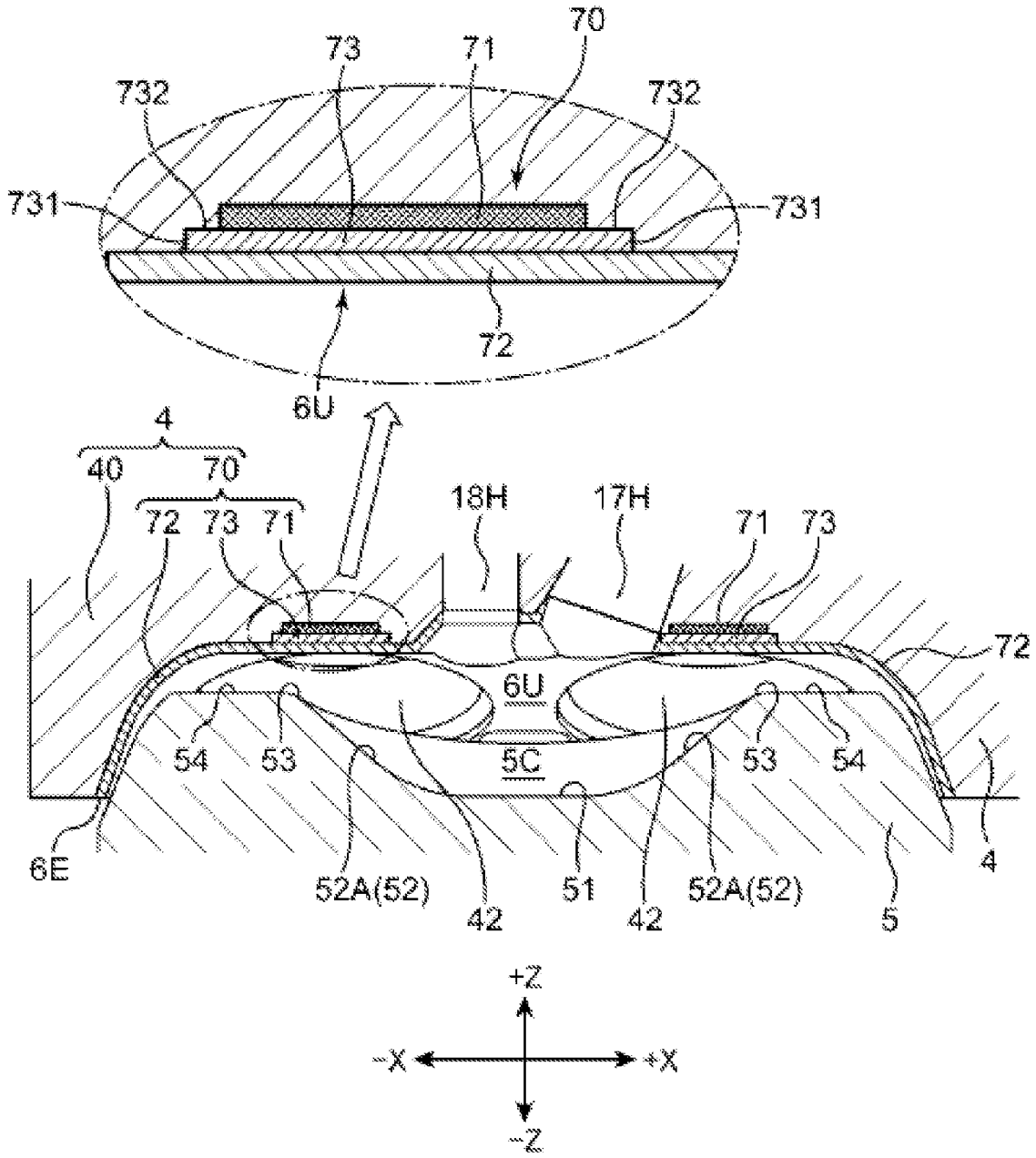
FIG. 5 is a cross-sectional view that is taken along line V-V in FIG. 4.
Figure 6:
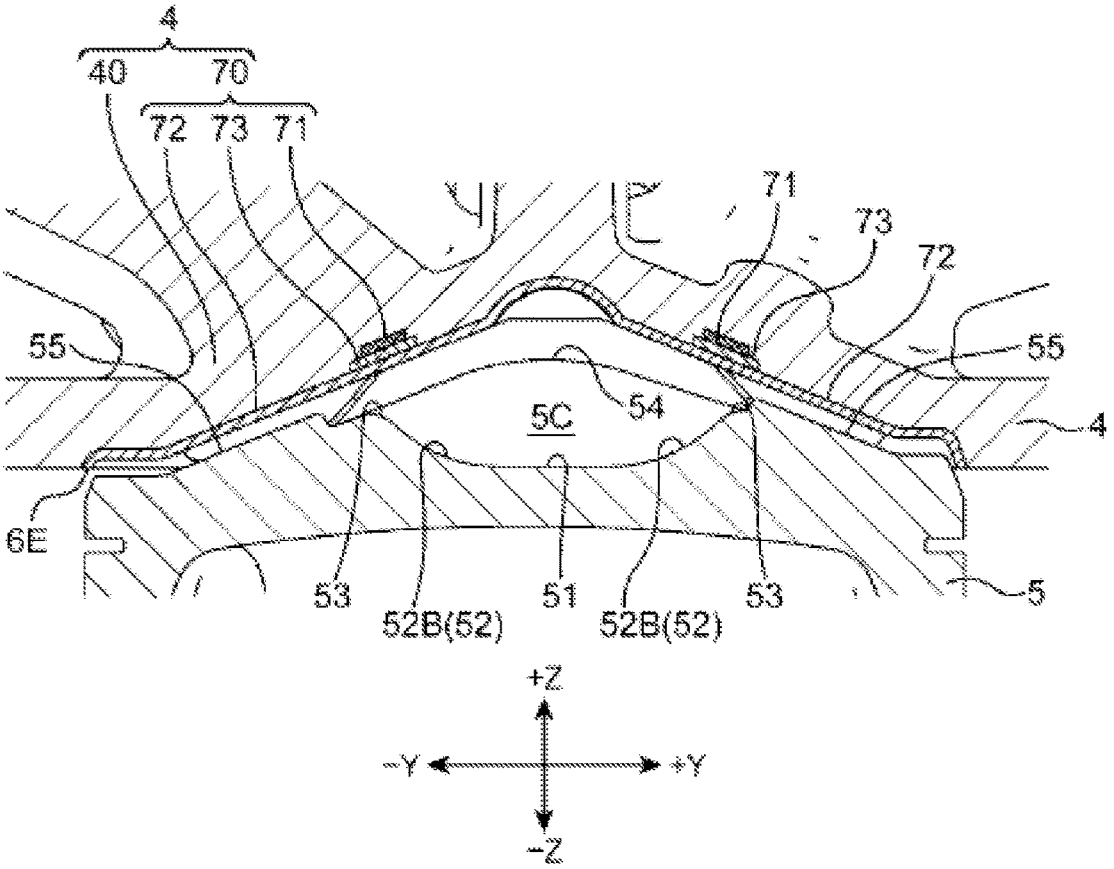
FIG. 6 is a cross-sectional view that is taken along line VI-VI in FIG. 4.

FIG. 4 is a plan view of the combustion chamber structure in this embodiment that is seen in top view and is a view illustrating a coat layer 70 that is provided to the lower surface 40A of the head body 40 in the First Example. FIG. 4 does not illustrate the head body 40 and illustrates the combustion chamber structure in which the combustion chamber 6 is seen in top view in a state where only the coat layer 70 is left. FIG. 5 is a cross-sectional view that is taken along line V-V in FIG. 4, and FIG. 6 is a cross-sectional view that is taken along line VI-VI in FIG. 4.

The cylinder head 4 in the First Example includes: the head body 40 that has the lower surface 40A opposing the combustion chamber 6; and the coat layer 70 arranged on the lower surface 40A. The coat layer 70 has holes including: openings that correspond to the intake-side opening 41 and the exhaust-side opening 42; a plug hole 17H that corresponds to an arrangement position of the ignition plug 17; an injector hole 18H that corresponds to an arrangement position of the injector 18. That is, the coat layer 70 is formed in the entire region of the combustion chamber ceiling surface 6U except for arrangement positions of the intake valve 11, the exhaust valve 12, the ignition plug 17, and the injector 18.

The coat layer 70 includes: a heat-insulating layer 71 and a heat-shielding layer 72 that are similar to the heat-insulating layer 710 and the heat-shielding layer 720 described in the comparative example; and a heat diffusion layer 73 that is not provided in the comparative example. The heat-shielding layer 72 is arranged to cover the entire region (the region other than the holes) of the lower surface 40A of the head body 40. An outer peripheral edge of the heat-shielding layer 72 reaches an outer peripheral edge 6E of the combustion chamber 6. The heat-insulating layer 71 is arranged in a part of a radially-center region of the lower surface 40A. The heat diffusion layer 73 is arranged between the heat-insulating layer 71 and the heat-shielding layer 72. The heat-insulating layer 71 is formed from a material with a lower thermal conductivity than the head body 40. The heat-shielding layer 72 is formed from a material with a lower thermal conductivity than the head body 40 and the heat-insulating layer 71. The heat diffusion layer 73 is formed from a material with a higher thermal conductivity than the heat-insulating layer 71 and the heat-shielding layer 72.

In the lower surface 40A, the heat-insulating layer 71 is arranged in the region (a part of the radially-center region) that opposes the raised surface 52 and the peripheral edge portion 53 of the cavity 5C. That is, as illustrated in FIG. 3A, the heat-insulating layer 71 is arranged in the region where the flame F, which is guided upward by the cavity 5C, blows and hits. The heat-insulating layer 71 has a specified thickness in the cylinder-axis direction and has a shape that extends from a lower end of the raised surface 52 to a slightly radially outer side of the peripheral edge section 53 in the plan view (FIG. 4) in the cylinder-axis direction. The raised surface 52 has the long-diameter side raised surface 52A with a relatively large width (the X-direction) and the short-diameter side raised surface 52B with a relatively small width (the Y-direction). Accordingly, a radial width of the heat-insulating layer 71 is larger in the X-direction than in the Y-direction. A thickness of the heat-insulating layer 71 in the cylinder-axis direction can be selected from a range of 1 mm to 6 mm, for example.

From a perspective of suppressing the release of the heat from the combustion chamber 6 through the cylinder head 4 (suppressing the cooling loss), the thermal conductivity of the heat-insulating layer 71 is desirably as low as possible, and the material, the thermal conductivity is at least lower than that for the head body 40 is used. In addition, from a perspective of maintaining the temperature of the lower surface 40A of the head body 40 to the high temperature, the heat-insulating layer 71 desirably has as high volume specific heat as possible, that is, desirably has the superior heat storage property.

In order to suppress the cooling loss through the head body 40, the heat-shielding layer 72 is arranged to cover the entire region of the lower surface 40A on which the heat-insulating layer 71 is arranged. That is, the heat-shielding layer 72 is exposed from the lower surface 40A. From a perspective of suppressing dissipation of the heat received by the lower surface 40A through the head body 40, the thermal conductivity of the heat-shielding layer 72 is set to be lower than that of the head body 40 and the heat-insulating layer 71. By providing the heat-shielding layer 72, the temperature difference between the combustion gas, which is produced in the combustion chamber 6, and the lower surface 40A can be reduced, and the cooling loss can thereby be reduced. A thickness of the heat-shielding layer 72 in the cylinder-axis direction can be selected from a range of 0.03 mm to 0.25 mm, for example.

The heat diffusion layer 73 is arranged between the heat-insulating layer 71 and the heat-shielding layer 72 such that a surface thereof on the combustion chamber 6 side contacts the heat-shielding layer 72 and that an opposing surface therefrom contacts the heat-insulating layer 71. In the lower surface 40A, the heat diffusion layer 73 is also arranged in the region that opposes the raised surface 52 and the peripheral edge portion 53 of the cavity 5C.

The heat diffusion layer 73 is a layer that has a function of releasing the heat stored in the heat-insulating layer 71 to the cylinder head 4 so as to prevent the temperature of the lower surface 40A, on which the heat-insulating layer 71 is arranged, from being raised to the high temperature. From a perspective of immediately transferring the heat stored in the heat-insulating layer 71 to the cylinder head 4, the thermal conductivity of the heat diffusion layer 73 is desirably as high as possible. Accordingly, the heat diffusion layer 73 is set as a layer provided with the higher thermal conductivity than the heat-insulating layer 71 and the heat-shielding layer 72. A thickness of the heat diffusion layer 73 in the cylinder-axis direction can be selected from a range of 1 mm to 5 mm, for example. Here, in a point of favorable heat diffusion, the heat diffusion layer 73 is desirably a layer with thermal resistance, which is expressed by "thermal conductivity/thickness", as low as possible. For this reason, the thickness of the heat diffusion layer 73 is set in consideration of the thermal conductivity of the material to be used.

The heat diffusion layer 73 includes a pair of side end edges 731 and an extending portion 732, each of which serves as an abutment portion that abuts the head body 40. The side end edges 731 on a radially inner side and a radially outer side are end edges on the radially inner side and the radially outer side of the heat diffusion layer 73. The extending portion 732 on the radially inner side is a portion that further extends inward from an inner peripheral edge on the radially inner side of the heat-insulating layer 71. The extending portion 732 on the radially outer side is a portion that further extends outward from an outer peripheral edge on the radially outer side of the heat-insulating layer 71. These side end edges 731 and extending portion 732 are portions, each of which directly contacts the head body 40 without being hampered by the heat-insulating layer 71. The heat diffusion layer 73 receives the heat that is excessively stored in the heat-insulating layer 71 and dissipates this heat from the side end edges 731 and the extending portion 732 to the head body 40. The heat diffusion layer 73 may have the same width as the heat-insulating layer 71 except for the extending portion 732, and each of the side end edges 731 may only be the portion that contacts the head body 40. Alternatively, the extending portion 732 may be provided only on one side of the radially inner side and the radially outer side.

A description will be made on operation of the coat layer 70 with the three-layer structure as described so far. The heat-shielding layer 72 is the layer with the extremely low thermal conductivity, and the temperature thereof varies depending on the inside temperature of the combustion chamber 6. Accordingly, the heat-shielding layer 72 can significantly block the heat transfer from the combustion gas in the combustion chamber 6 to the head body 40. In this way, the cooling loss can be reduced. However, since the heat-shielding layer 72 cannot block the heat transfer completely, the heat passes through the heat-shielding layer 72 to a certain extent. In this embodiment, since the heat-insulating layer 71 is formed from a member with the high volume specific heat, the heat-insulating layer 71 exhibits the superior heat storage function. Accordingly, the heat that has passed through the heat-shielding layer 72 and the heat in a surrounding area are stored in the heat-insulating layer 71.

Then, the heat-insulating layer 71 that stores the heat heats the heat-shielding layer 72. As a result, the lower surface 40A, on which the heat-insulating layer 71 is arranged, can be maintained at the high temperature. However, as described in the above-described comparative example, when the temperature of the combustion gas falls within the relatively high operation range, the heat-insulating layer 71 stores the high heat. As a result, the heat-shielding layer 72 is excessively heated, which causes the preignition. In order to prevent such a defect, the heat diffusion layer 73 is arranged between the heat-insulating layer 71 and the heat-shielding layer 72 to receive the heat from the heat-insulating layer 71. The heat that is received by the heat diffusion layer 73 from the heat-insulating layer 71 is dissipated from the side end edges 731 and the extending portion 732, each of which is the abutment portion, to the head body 40. Thus, it is possible to prevent the occurrence of the preignition in advance while preventing the excessive temperature rise of the lower surface 40A to the high temperature.

Next, a description will be made on material examples that can favorably be used as components of the combustion chamber 6. As a base material for the cylinder block 3 and a base material for the cylinder head 4, a cast product that is made from a metal base material such as an aluminum alloy AC4B (thermal conductivity=96 W/mK, volume specific heat=2,667 kJ/m$^3$K). In addition, as a base material for the piston 5, an aluminum alloy AC8A (thermal conductivity=125 W/mK, volume specific heat=2,600 kJ/m$^3$K) can be used.

As the base material for the intake valve 11 and the exhaust valve 12, heat-resisting steel with superior heat resistance, superior wear resistance, and superior corrosion resistance can be used. For example, as the base material for the intake valve 11, martensitic heat-resisting steel SUH11 that contains chromium, silicon, and carbon as bases (thermal conductivity=25 W/mK, volume specific heat=3,850 kJ/m$^3$K) can be used. In addition, as the base material for the exhaust valve 12, austenitic heat-resisting steel SUH35 that contains chromium, nickel, and carbon as bases (thermal conductivity=18 W/mK, volume specific heat=3,565 kJ/m$^3$K) can be used.

For the heat-shielding layer 72, of the components (the head body 40, the heat-insulating layer 71, the heat-shielding layer 72, and the heat diffusion layer 73) of the cylinder head 4, the material with the lowest thermal conductivity and the lowest volume specific heat is selected. That is, the material(s) forming the heat-shielding layer 72 are selected such that the heat-shielding layer 72 becomes the layer from which the heat dissipation is less likely to occur and where the heat is less likely to be stored. A preferable range of the thermal conductivity of the heat-shielding layer 72 is about 0.05 to 1.50 W/mK, and a preferable range of the volume specific heat thereof is about 500 to 1,500 kJ/m$^3$K.

As a material that can satisfy the above conditions for the heat-shielding layer 72, the heat-resistant silicone resin can be exemplified. An example of the silicone resin is a silicone resin that contains a three-dimensional polymer with a high branching degree, and representative examples of such a silicone resin are a methyl silicone resin and a methylphenyl silicone resin. For example, polyalkylphenylsiloxane or the like is preferred. Such a silicone resin may contain a hollow particle such as a shirasu balloon. For example, the heat-shielding layer 72 can be formed by subjecting the lower surface 40A, which is formed with the heat-insulating layer 71 and the heat diffusion layer 73, in the head body 40 into coating treatment using the above silicone resin.

The heat-insulating layer 71 is the layer, the heat diffusion from which is less likely to occur, and which easily stores the heat. In order to suppress the heat diffusion, for the heat-insulating layer 71, a material with the thermal conductivity that is higher than the heat-shielding layer 72 but is much lower than the head body 40 is selected. In addition, in order to have the favorable heat storage property, for the heat-insulating layer 71, a material with the higher volume specific heat and the higher thermal resistance than the heat-shielding layer 72 is selected. A preferable range of the thermal conductivity of the heat-insulating layer 71 is about 0.2 to 10 W/mK, and a preferable range of the volume specific heat thereof is about 1,800 to 3,500 kJ/m$^3$K.

As a material that can satisfy the above conditions for the heat-insulating layer 71, a ceramic material can be exemplified. In general, the ceramic material has the low thermal conductivity, the high volume specific heat, and the superior heat resistance. Thus, the ceramic material is preferred as the heat-insulating layer 71. More specifically, the preferred ceramic material is zirconia (thermal conductivity=3 W/mK, volume specific heat=2,576 kJ/m$^3$K). In addition thereto, the ceramic material such as silicon nitride, silica, cordierite, or mullite, a porous SUS-based material, calcium silicate, or the like can also be used as a constituent material for the heat-insulating layer 71.

The heat diffusion layer 73 plays a role of dissipating the heat stored in the heat-insulating layer 71 from the side end edges 731 and the extending portion 732 to the head body 40. Thus, the heat diffusion layer 73 is a layer from which the heat is easily diffused. Thus, of the components of the cylinder head 4, the heat diffusion layer 73 is a layer with the highest thermal conductivity. A preferable range of the thermal conductivity of the heat diffusion layer 73 is about 35 to 600 W/mK. In addition, the thickness of the heat diffusion layer 73 is desirably set such that the thermal resistance falls within a range from 0.002 to 0.06 m$^2$K/W. As the material, which satisfies the above conditions, for the heat diffusion layer 73, for example, a copper-based material (thermal conductivity=400 W/mK, volume specific heat=3, 500 kJ/m$^3$K), a Corson alloy, beryllium copper, a fiber-reinforced aluminum alloy, a titanium aluminum, or the like can be used. In the case where the copper-based material is used, and even in the case where a thickness thereof is set to 2 mm, the heat diffusion layer 73 can have the thermal resistance=0.005 m$^2$K/W and thus is particularly preferred.

FIG. 7 illustrates preferable material selection examples of the base material for the intake valve 11 and the exhaust valve 12, the base material for the cylinder block 3, the cylinder head 4, and the piston 5, the heat-insulating layer 71, the heat-shielding layer 72, and the heat diffusion layer 73. FIG. 7 illustrates thermal conductivity $\lambda$, volume specific heat $\rho c$, thermal diffusivity ($\lambda/\rho c$), a Z-direction thickness t, thermal resistance ($t/\lambda$), and heat permeability ($\sqrt{\lambda\rho c}$). A small row on a right side in the thermal diffusivity shows a ratio in each layer in the case where the thermal diffusivity of the heat-shielding layer 72 is set to "1."

According to the combustion chamber structure in the First Example that has been described so far, in the region, the temperature of which is especially raised to the high temperature during the combustion, in the lower surface 40A of the head body 40, the heat-insulating layer 71 and the heat diffusion layer 73 are provided on the back surface of the heat-shielding layer 72. That is, in the region where the flame F is guided to the cavity 5C and blows and hits (the region opposing the raised surface 52 and the peripheral edge portion 53), the coat layer 70, which covers the lower surface 40A, has the three-layer structure including the heat-insulating layer 71, the heat-shielding layer 72, and the heat diffusion layer 73, which is interposed therebetween. Since the heat-insulating layer 71 is arranged in the region where the flame F blows and hits, the cooling loss can be reduced. In addition, due to the interposition of the heat diffusion layer 73, the excess heat that is stored in the heat-insulating layer 71 can be diffused from the side end edges 731 and the extending portion 732 to the head body 40. Thus, an excessive temperature rise of the heat-shielding layer 72 can be suppressed.

Second Example

Figure 8:
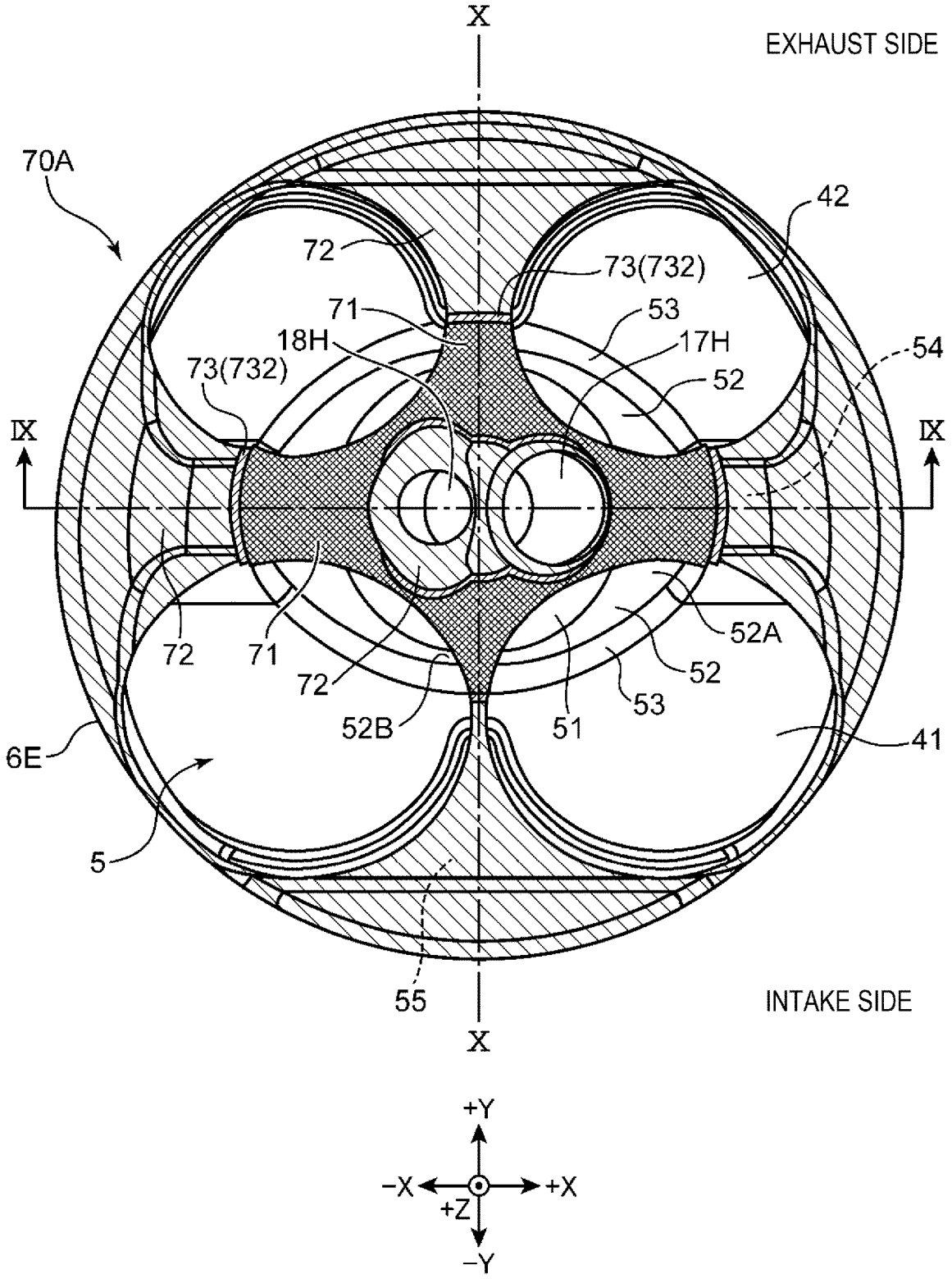
FIG. 8 is a plan view illustrating a coat layer in a Second Example.
Figure 9:
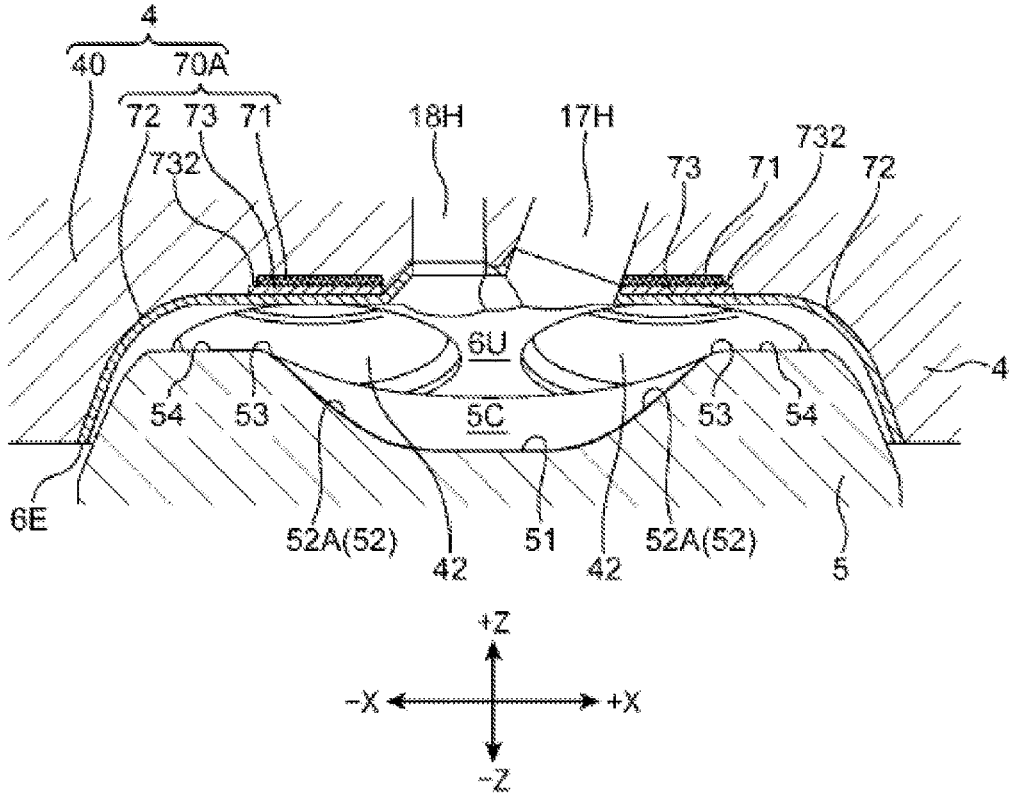
FIG. 9 is a cross-sectional view that is taken along line IX-IX in FIG. 8.
Figure 10:
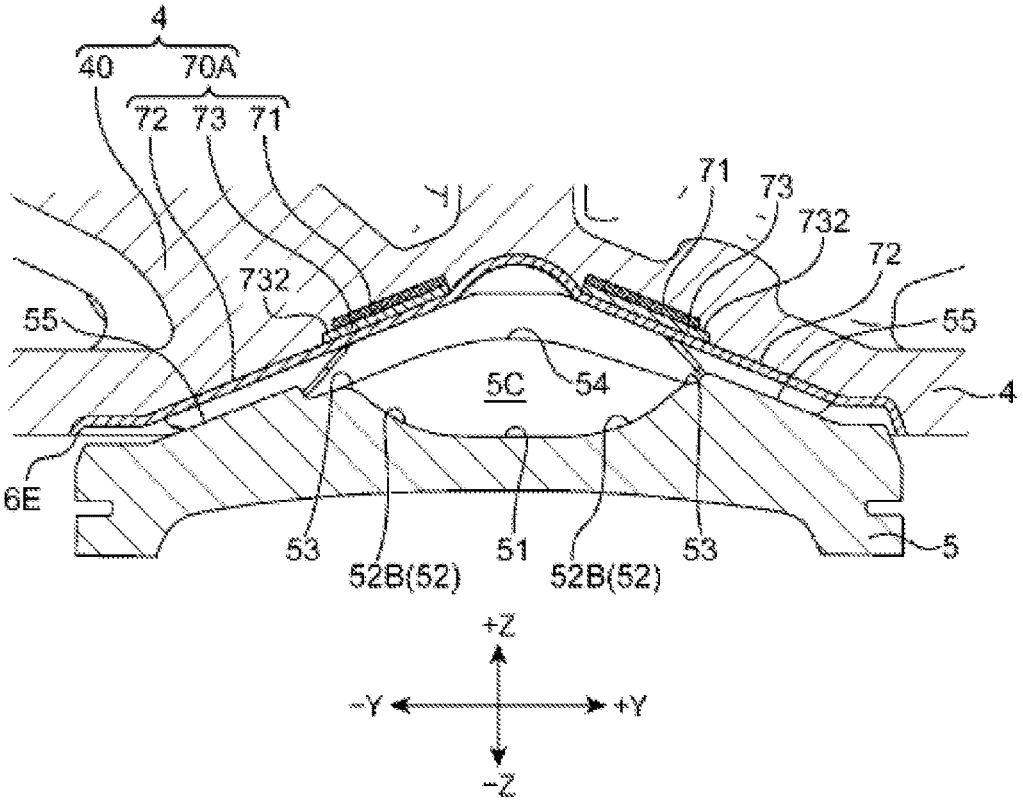
FIG. 10 is a cross-sectional view that is taken along line X-X in FIG. 8.

In the Second Example, a description will be made on an example in which the heat-insulating layer 71 and the heat diffusion layer 73 are expanded from those in the First Example. FIG. 8 is a plan view illustrating a coat layer 70A in the Second Example. FIG. 9 is a cross-sectional view that is taken along line IX-IX in FIG. 8, and FIG. 10 is a cross-sectional view that is taken along line X-X in FIG. 8. The coat layer 70A includes: the heat-shielding layer 72 that is arranged to cover the entire region of the lower surface 40A of the head body 40; and the heat-insulating layer 71 and the heat diffusion layer 73 that are expanded radially inward from those in the First Example.

In the lower surface 40A of the head body 40, the heat-insulating layer 71 and the heat diffusion layer 73 in the Second Example are arranged in the region that opposes the cavity 5C of the piston 5. In the First Example, the description has been made on the example in which the heat-insulating layer 71 and the heat diffusion layer 73 are provided in the region that opposes the raised surface 52 and the peripheral edge portion 53 of the cavity 5C. Meanwhile, in the Second Example, the description will be made on the example in which the heat-insulating layer 71 and the heat diffusion layer 73 are also arranged in a region that opposes the bottom surface 51 of the cavity 5C. The outer peripheral edge of heat-shielding layer 72 extends to the outer peripheral edge 6E of the combustion chamber 6 and coats the entire region of the lower surface 40A except for the above holes. The heat-insulating layer 71 is arranged in the radially-center region, which opposes the cavity 5C, in the lower surface 40A. The heat diffusion layer 73 is arranged between the heat-insulating layer 71 and the heat-shielding layer 72. However, since the region near the plug hole 17H and the injector hole 18H is a region with a complex shape, the heat-insulating layer 71 and the heat diffusion layer 73 are not arranged.

The heat diffusion layer 73 has the extending portion 732 that extends radially outward from the heat-insulating layer 71. Similar to the First Example, the extending portion 732 is the portion that directly abuts the head body 40. Accordingly, when the temperature of the heat-insulating layer 71 is excessively raised to the high temperature, the heat diffusion layer 73 receives such heat and can dissipate the heat to the head body 40 through the extending portion 732.

In general, in the case where the piston 5 is provided with the cavity 5C in the radially-center region of the crown surface 5H, the temperature of the radially-center region in the combustion chamber 6 tends to be raised to the high temperature during the combustion. Naturally, the temperature of the region, which opposes the cavity 5C, in the lower surface 40A of the head body 40 is also raised to the high temperature. According to the combustion chamber structure in the Second Example, the heat-insulating layer 71 is arranged in the region, which opposes the cavity 5C, in the lower surface 40A. That is, in the region, the temperature of which is raised to the high temperature during the combustion, in the lower surface 40A, the heat-insulating layer 71 is arranged on the back surface side of the heat-shielding layer 72. Thus, the temperature difference between the combustion gas in the combustion chamber 6 and the heat-shielding layer 72 (the lower surface 40A) can be reduced as small as possible, and the cooling loss can thereby be reduced. Meanwhile, since the heat of the heat-insulating layer 71 is dissipated to the head body 40 due to the interposition of the heat diffusion layer 73, the temperature of the heat-shielding layer 72 is not raised excessively.

Third Example

Figure 11:
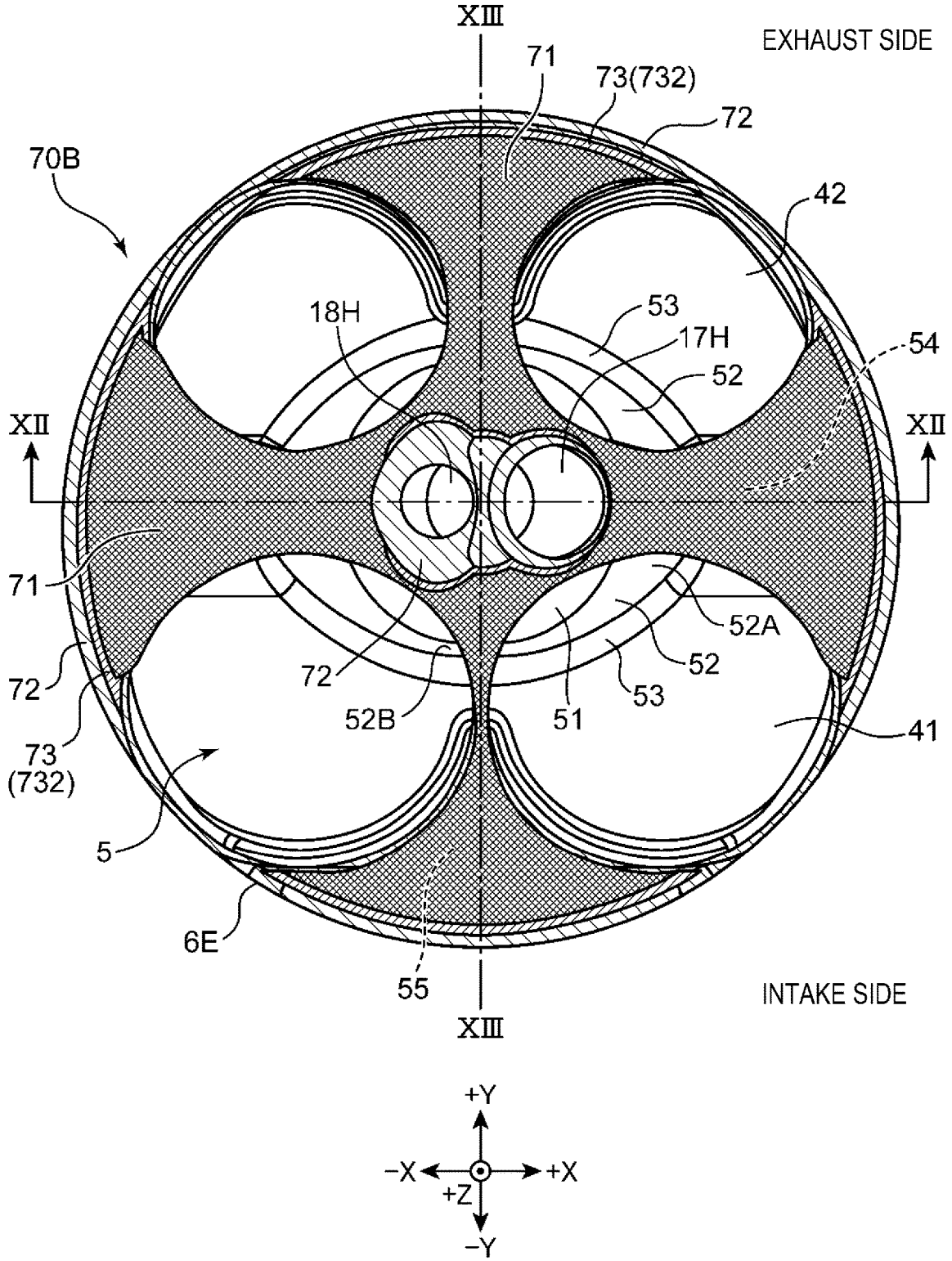
FIG. 11 is a plan view illustrating a coat layer in a Third Example.
Figure 12:
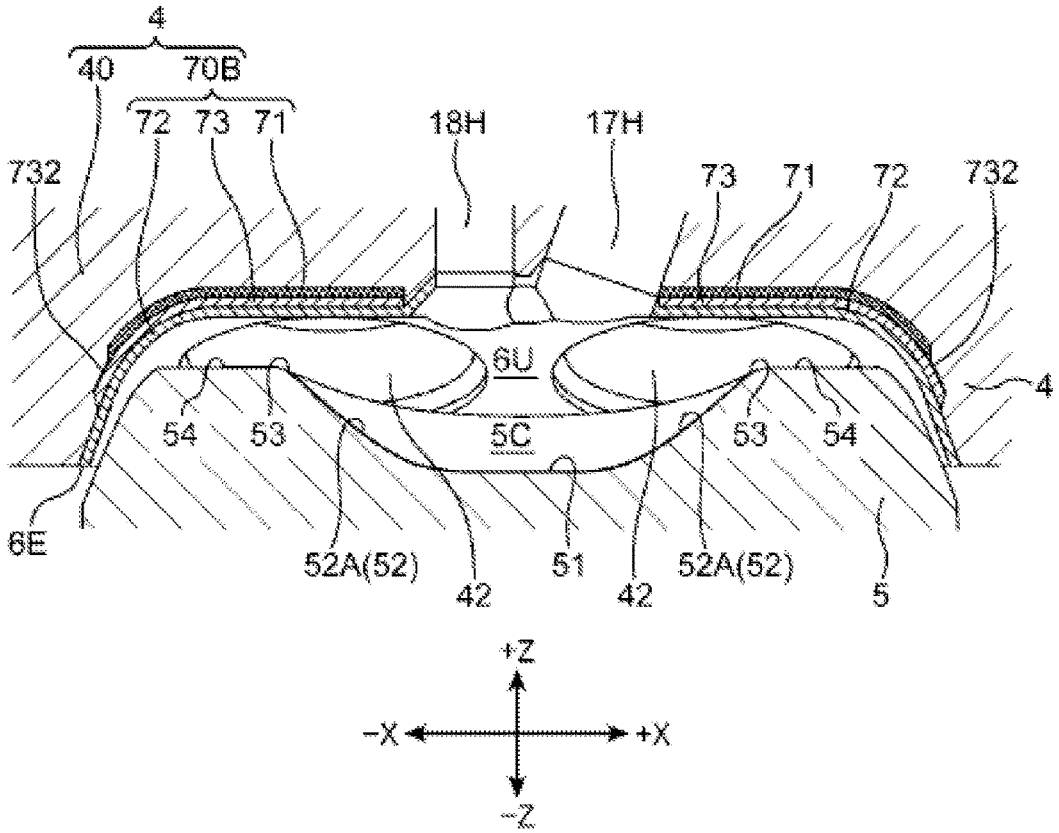
FIG. 12 is a cross-sectional view that is taken along line XII-XII in FIG. 11.
Figure 13:
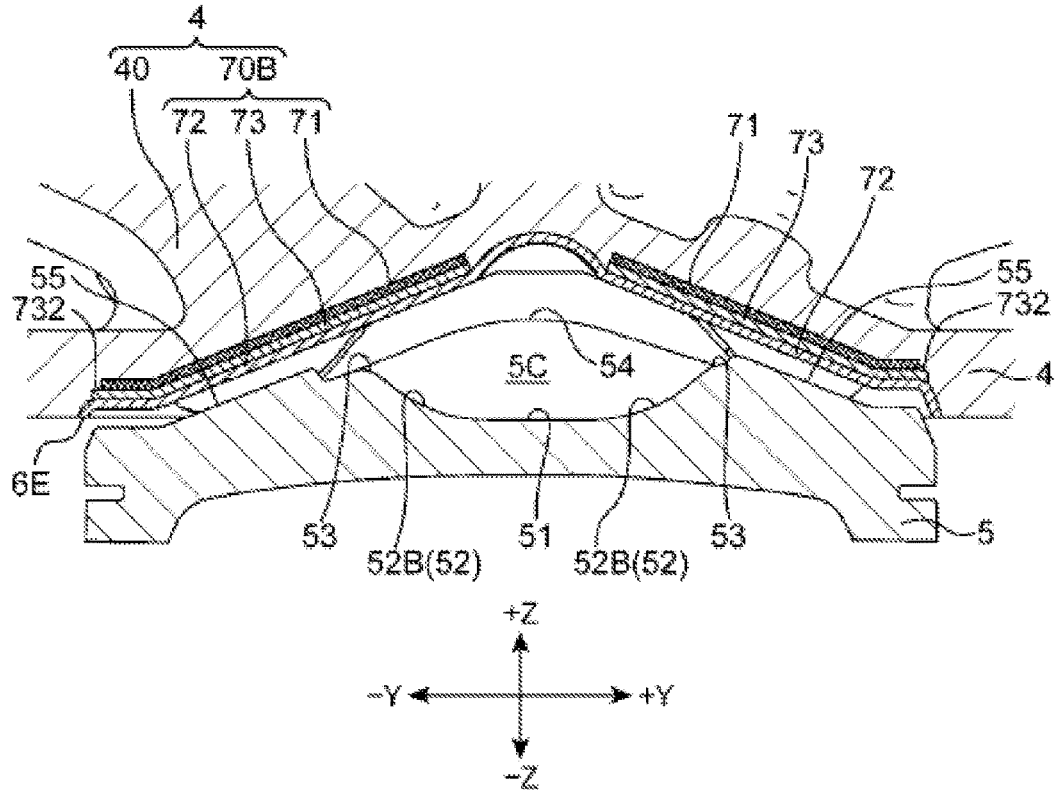
FIG. 13 is a cross-sectional view that is taken along line XIII-XIII in FIG. 11.

FIG. 11 is a plan view illustrating a coat layer 70B in the Third Example. FIG. 12 is a cross-sectional view that is taken along line XII-XII in FIG. 11, and FIG. 13 is a cross-sectional view that is taken along line XIII-XIII in FIG. 11. The coat layer 70B includes: the heat-shielding layer 72 that is arranged to cover the entire region of the lower surface 40A of the head body 40; and the heat-insulating layer 71 and the heat diffusion layer 73 that are expanded radially outward from those in the Second Example.

The heat-insulating layer 71 and the heat diffusion layer 73 in the Third Example are arranged in the substantially entire region of the lower surface 40A of the head body 40. The heat-insulating layer 71 and the heat diffusion layer 73 are arranged in the region that opposes the cavity 5C of the piston 5, and are also arranged in the region that opposes the mountain portion 54 and the squish portion 55 positioned on the radially outer side of the cavity 5C. The outer peripheral edge of the heat-insulating layer 71 extends to the outer peripheral edge 6E of the combustion chamber 6. However, similar to the Second Example, the heat-insulating layer 71 and the heat diffusion layer 73 are not arranged in the region near the plug hole 17H and the injector hole 18H. In addition, while the heat-insulating layer 71 and the heat diffusion layer 73 substantially extend to the outer peripheral edge 6E, strictly, the heat-insulating layer 71 and the heat diffusion layer 73 are not arranged in a region near the outer peripheral edge 6E.

The heat diffusion layer 73 has the extending portion 732 that extends radially outward from the heat-insulating layer 71. Similar to the First and Second Examples, the extending portion 732 is the portion that directly abuts the head body 40. In this embodiment, the extending portion 732 is positioned near the outer peripheral edge 6E.

According to the combustion chamber structure in the Third Example, since the heat-insulating layer 71 is arranged in the substantially entire region of the lower surface 40A of the head body 40, the cooling loss through the cylinder head 4 can be suppressed at a maximum. In addition, when the temperature of the heat-insulating layer 71 is excessively raised to the high temperature, the heat diffusion layer 73 receives such heat and can dissipate the heat to the head body 40 through the extending portion 732.

[Operational Effects]

In the combustion chamber structure for the engine according to this embodiment that has been described so far, the lower surface 40A of the head body 40 is covered with the heat-shielding layer 72, the thermal conductivity of which is lower than that of the head body 40 of the cylinder head 4 and the heat-insulating layer 71. Thus, the temperature difference between the combustion gas in the combustion chamber 6 and the lower surface 40A can be reduced, and the heat transfer to the head body 40 (the cooling loss) can thereby be reduced. The heat-insulating layer 71 stores the heat that has passed through the heat-shielding layer 72. Thus, the heat-shielding layer 72 can be maintained at the high temperature. Meanwhile, the heat diffusion layer 73 is arranged between the heat-insulating layer 71 and the heat-shielding layer 72. The heat diffusion layer 73 includes the abutment portions (the side end edges 731 and the extending portion 732), the thermal conductivity of each of which is higher than that of both of the heat-insulating layer 71 and the heat-shielding layer 72, and each of which abuts the head body 40. In addition, even when the heat-insulating layer 71 is brought into a state of excessively storing the heat, such heat can be dissipated to the head body 40 through the heat diffusion layer 73. Thus, it is possible to prevent the temperature rise of the lower surface 40A of the head body 40 to the high temperature, which possibly causes the preignition.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims. Further, if used herein, the phrase "and/or" means either or both of two stated possibilities.

DESCRIPTION OF REFERENCE CHARACTERS

1 engine body
2 cylinder
3 cylinder block
4 cylinder head
40 head body
40A lower surface
5 piston
5H crown surface (upper surface)
5C cavity
51 bottom surface
52 raised surface
53 peripheral edge portion
6 combustion chamber
6E outer peripheral edge

71 heat-insulating layer
72 heat-shielding layer
73 heat diffusion layer
731 side end edge (abutment portion)
732 extending portion (abutment portion)
PIG preignition

The invention claimed is:

1. A combustion chamber structure for an engine, comprising:

a combustion chamber that is defined by a cylinder block, a cylinder head, and a piston, wherein the cylinder head includes:

a head body that has a lower surface opposing the combustion chamber;

a heat-insulating layer that is arranged on the lower surface and has a lower thermal conductivity than the head body;

a heat-shielding layer that is arranged to cover the lower surface and has a lower thermal conductivity than the head body and the heat-insulating layer; and a heat diffusion layer that is arranged between the heat-insulating layer and the heat-shielding layer and has a higher thermal conductivity than the heat-insulating layer and the heat-shielding layer, and the heat diffusion layer includes an abutment portion that abuts the head body.

2. The combustion chamber structure for the engine according to claim 1, wherein the heat-insulating layer is arranged in a part of a radially-center region of the lower surface.

3. The combustion chamber structure for the engine according to claim 2, wherein the heat diffusion layer includes an extending portion that extends toward a radially outer side of an outer peripheral edge of the heat-insulating layer and/or toward a radially inner side of an inner peripheral edge of the heat-insulating layer, and the extending portion is the abutment portion that abuts the head body.

4. The combustion chamber structure for the engine according to claim 3, wherein in a radially-center region of an upper surface, the piston includes a cavity that is dented downward in a cylinder-axis direction, and in the lower surface of the head body, the heat-insulating layer and the heat diffusion layer are arranged in a region that opposes the cavity.

5. The combustion chamber structure for the engine according to claim 4, wherein the cavity includes:

a bottom surface that is formed with the most dented portion in the cylinder-axis direction;

a raised surface that is raised radially outward and upward from the bottom surface; and a peripheral edge portion that is an upper end edge of the raised surface, and in the lower surface of the head body, the heat-insulating layer and the heat diffusion layer are arranged in a region that opposes the raised surface and the peripheral edge portion.

6. The combustion chamber structure for the engine according to claim 5, wherein outer peripheral edges of the heat-insulating layer and the heat diffusion layer extend to an outer peripheral edge of the combustion chamber or a portion near the outer peripheral edge of the combustion chamber.

7. The combustion chamber structure for the engine according to claim 4, wherein outer peripheral edges of the heat-insulating layer and the heat diffusion layer extend to an outer peripheral edge of the combustion chamber or a portion near the outer peripheral edge of the combustion chamber.

8. The combustion chamber structure for the engine according to claim 3, wherein outer peripheral edges of the heat-insulating layer and the heat diffusion layer extend to an outer peripheral edge of the combustion chamber or a portion near the outer peripheral edge of the combustion chamber.

9. The combustion chamber structure for the engine according to claim 2, wherein in a radially-center region of an upper surface, the piston includes a cavity that is dented downward in a cylinder-axis direction, and in the lower surface of the head body, the heat-insulating layer and the heat diffusion layer are arranged in a region that opposes the cavity.

10. The combustion chamber structure for the engine according to claim 9, wherein the cavity includes:

a bottom surface that is formed with the most dented portion in the cylinder-axis direction;

a raised surface that is raised radially outward and upward from the bottom surface; and a peripheral edge portion that is an upper end edge of the raised surface, and in the lower surface of the head body, the heat-insulating layer and the heat diffusion layer are arranged in a region that opposes the raised surface and the peripheral edge portion.

11. The combustion chamber structure for the engine according to claim 2, wherein outer peripheral edges of the heat-insulating layer and the heat diffusion layer extend to an outer peripheral edge of the combustion chamber or a portion near the outer peripheral edge of the combustion chamber.

12. The combustion chamber structure for the engine according to claim 1, wherein the heat diffusion layer includes an extending portion that extends toward a radially outer side of an outer peripheral edge of the heat-insulating layer and/or toward a radially inner side of an inner peripheral edge of the heat-insulating layer, and the extending portion is the abutment portion that abuts the head body.

13. The combustion chamber structure for the engine according to claim 12, wherein in a radially-center region of an upper surface, the piston includes a cavity that is dented downward in a cylinder-axis direction, and in the lower surface of the head body, the heat-insulating layer and the heat diffusion layer are arranged in a region that opposes the cavity.

14. The combustion chamber structure for the engine according to claim 13, wherein the cavity includes:

a bottom surface that is formed with the most dented portion in the cylinder-axis direction;

a raised surface that is raised radially outward and upward from the bottom surface; and a peripheral edge portion that is an upper end edge of the raised surface, and in the lower surface of the head body, the heat-insulating layer and the heat diffusion layer are arranged in a region that opposes the raised surface and the peripheral edge portion.

15. The combustion chamber structure for the engine according to claim 12, wherein outer peripheral edges of the heat-insulating layer and the heat diffusion layer extend to an outer peripheral edge of the combustion chamber or a portion near the outer peripheral edge of the combustion chamber.

16. The combustion chamber structure for the engine according to claim 1, wherein in a radially-center region of an upper surface, the piston includes a cavity that is dented downward in a cylinder-axis direction, and in the lower surface of the head body, the heat-insulating layer and the heat diffusion layer are arranged in a region that opposes the cavity.

17. The combustion chamber structure for the engine according to claim 16, wherein the cavity includes:

a bottom surface that is formed with the most dented portion in the cylinder-axis direction;

a raised surface that is raised radially outward and upward from the bottom surface; and a peripheral edge portion that is an upper end edge of the raised surface, and in the lower surface of the head body, the heat-insulating layer and the heat diffusion layer are arranged in a region that opposes the raised surface and the peripheral edge portion.

18. The combustion chamber structure for the engine according to claim 16, wherein outer peripheral edges of the heat-insulating layer and the heat diffusion layer extend to an outer peripheral edge of the combustion chamber or a portion near the outer peripheral edge of the combustion chamber.

19. The combustion chamber structure for the engine according to claim 1, wherein outer peripheral edges of the heat-insulating layer and the heat diffusion layer extend to an outer peripheral edge of the combustion chamber or a portion near the outer peripheral edge of the combustion chamber.

20. The combustion chamber structure for the engine according to claim 1, wherein the heat-insulating layer is composed of a ceramic material, the heat-shielding layer is composed of a heat-resistant silicone resin, and the heat diffusion layer is composed of a copper-based material, a Corson alloy, beryllium copper, a fiber-reinforced aluminum alloy, or a titanium aluminum.

* * * * *